US006224369B1

(12) United States Patent
Moneyhun

(10) Patent No.: US 6,224,369 B1
(45) Date of Patent: May 1, 2001

(54) DEVICE AND METHOD FOR BURNING VENTED FUEL

(76) Inventor: David H. Moneyhun, 1235 Crown Point Way, Rock Springs, WY (US) 82901

( * ) Notice: Subject to any disclaimer, the term of this patent is extended or adjusted under 35 U.S.C. 154(b) by 0 days.

(21) Appl. No.: 09/324,150

(22) Filed: Jun. 2, 1999

(51) Int. Cl.[7] ..... F23D 14/00; F23G 7/06

(52) U.S. Cl. ..... 431/202; 431/5; 431/9; 431/116; 431/171

(58) Field of Search ..... 431/202, 5, 171, 431/8, 9, 115, 116; 126/299 F, 307 A; 110/203, 210, 211, 212, 213, 217

(56) References Cited

U.S. PATENT DOCUMENTS

| | | | | |
|---|---|---|---|---|
| 3,408,167 | * | 10/1968 | Burden, Jr. | 110/213 |
| 3,497,308 | | 2/1970 | Flynn . | |
| 3,566,809 | * | 3/1971 | Carry | 110/212 |
| 3,607,120 | | 9/1971 | Nesbitt et al. | 431/202 |
| 3,771,940 | | 11/1973 | Stranahan et al. | 431/202 |
| 3,807,940 | | 4/1974 | Juricek | 431/202 |
| 3,822,984 | | 7/1974 | Straitz, III | 431/202 |
| 3,829,964 | | 8/1974 | Critchlow et al. . | |
| 3,850,581 | * | 11/1974 | Hills et al. | 431/202 |
| 3,852,023 | | 12/1974 | Itoh et al. | 431/202 |
| 4,548,577 | | 10/1985 | McGill | 413/202 |
| 4,610,622 | * | 9/1986 | Quinnell | 431/5 |
| 4,856,985 | * | 8/1989 | Ochel et al. | 431/202 |
| 4,941,415 | * | 7/1990 | Pope et al. | 110/212 |
| 4,975,042 | | 12/1990 | Schwarz | 431/5 |
| 5,396,960 | | 3/1995 | Marcott et al. | 431/202 |
| 5,735,680 | | 4/1998 | Henkelmann | 431/5 |
| 5,810,578 | | 9/1998 | Hystad et al. | 431/202 |

* cited by examiner

*Primary Examiner*—James C. Yeung
*Assistant Examiner*—Josiah C. Cocks
(74) *Attorney, Agent, or Firm*—Thorpe, North & Western, LLP

(57) ABSTRACT

A device for burning vented fuel has a housing defining and substantially enclosing a combustion chamber. The housing has an air inlet, a vented fuel inlet, and an exhaust gas outlet. A manifold burner is disposed in the combustion chamber and conveys the vented fuel into the combustion chamber. An ignition device is disposed in the chamber for igniting the vented fuel. The manifold burner and exhaust gas outlet define a direct exhaust gas path extending linearly from the manifold burner to the exhaust gas outlet. A deflection shield is disposed in the direct exhaust gas path, and is sized at least as large as the approximate size of the exhaust gas outlet, for substantially deflecting exhaust gas and heat produced by the combustion of vented fuel away from the exhaust gas outlet. The deflection shield is displaced from the exhaust gas outlet to create a gap for allowing exhaust gas to escape the combustion chamber along a nonlinear path.

21 Claims, 4 Drawing Sheets

DEVICE AND METHOD FOR BURNING VENTED FUEL

BACKGROUND OF THE INVENTION

1. Field of the Invention

The present invention relates to a device and method for burning vented fuel from oil wells and the like. More particularly, the present invention relates to a device and method having a deflection shield disposed in a linear, direct exhaust gas path between a manifold burner and an exhaust gas outlet of a combustion chamber for preventing the direct, linear escape of heat from the combustion chamber through the exhaust gas outlet.

2. Prior Art

Fuel production wells, such as crude oil wells and natural gas wells, typically extract a mixture of oil, water, and condensate from a well head. The mixture is piped to a separator system which separates the oil, water and condensate. The oil, water, and condensate are then piped to separate storage tanks. Vapors or vented fuel is created by the oil, water, and condensate as they are stored in the tanks. The vapors are not considered useful because any fuel contained in the vapors is not easily recoverable. Thus, these vapors are typically either vented to the atmosphere, or piped to a flare and burned.

One disadvantage of venting the unwanted vapors into the atmosphere is the pollution caused by such vapors. In addition, the Department of Environmental Quality (DEQ) requires that the wells comply with certain requirements. The regulations annually reduce the amount of vapor that may be emitted into the atmosphere. It is generally considered that any wells producing over 3 barrels of condensate must dispose of the unwanted vapors without venting them to the atmosphere in order to comply with DEQ requirements.

As indicated above, another method of disposing of the unwanted fuels is to burn them off with an open flame. Such systems usually have an open pipe with a circular burner. A refractory substance is disposed in the pipe to retain heat. One disadvantage of flaring-off the vented fuels is that the flare is not efficient, and may actually produce more harmful pollution than simply venting the vapors to the atmosphere. Such flares may be only 60 to 65% efficient. Such inefficient burning may create harmful anti-oxidants.

Another method for dealing with the vented fuel utilizes a recovery system to recover usable fuel from the vapor. Such recovery systems take the vapors from the separators and tanks and compress them for reuse. One disadvantage with the recovery systems is that they are relatively expensive.

Therefore, it would be advantageous to develop a device and method capable of efficiently and properly disposing of unwanted vapors or vented fuels. It also would be advantageous to develop such a device and method which are inexpensive to manufacture and operate.

OBJECTS AND SUMMARY OF THE INVENTION

It is an object of the present invention to provide a device and method for efficiently and properly combusting vented fuels.

It is another object of the present invention to provide such a device and method which are simple and inexpensive to manufacture and operate.

These and other objects and advantages of the present invention are realized in a burner device for burning vented fuels. The burner device has a housing defining and substantially enclosing a combustion chamber. The housing has an air inlet configured for allowing air into the combustion chamber; a vented fuel inlet configured for allowing vented fuel into the combustion chamber; and an exhaust gas outlet configured for allowing exhaust gases out of the combustion chamber.

A manifold burner is coupled to the vented fuel inlet and disposed in the combustion chamber for conveying the vented fuel into the combustion chamber. An ignition device, such as a pilot burner, may be disposed in the chamber for igniting the vented fuel as the vented fuel enters the combustion chamber. The manifold burner and exhaust gas outlet define a direct exhaust gas path extending linearly from the manifold burner to the exhaust gas outlet.

A deflection shield advantageously is disposed in the direct exhaust gas path for substantially deflecting exhaust gases and heat produced by the combustion of vented fuel away from the exhaust gas outlet. The deflection shield is sized at least as large as the approximate size of the exhaust gas outlet. The deflection shield is displaced from the exhaust gas outlet to create a gap for allowing exhaust gases to escape the combustion chamber along a nonlinear path. Thus, the exhaust gas and heat produced by the combustion of vented gas is prevented from flowing directly out of the combustion chamber along the direct exhaust path.

In accordance with one aspect of the present invention, the deflection shield has a surface with a concave curvature facing the combustion chamber. The concave curvature helps recirculate the exhaust gases back to the manifold.

In accordance with another aspect of the present invention, a grating is disposed in the housing below the manifold burner, and divides the housing into two portions including the combustion chamber and a plenum. It is believed that the grating helps cause turbulent flow and assist combustion.

In accordance with another aspect of the present invention, the housing walls include angled walls tapering towards the exhaust opening for funneling exhaust gas towards the exhaust opening.

A method of using the burner device described above for burning vented fuels includes:

a) providing a substantially enclosed combustion chamber having an air inlet, a vented fuel inlet, and an exhaust gas outlet;

b) providing a manifold burner in the combustion chamber and having a passage and outlets for introducing the vented fuel into the combustion chamber, the manifold burner and exhaust outlet defining a direct exhaust gas path extending linearly from the manifold burner to the exhaust outlet;

c) introducing air into the chamber through the air inlet;

d) introducing the vented fuel into the chamber through the outlets in the manifold burner;

e) igniting the vented fuel and combusting the vented fuel; and f) obstructing the direct exhaust gas path with a deflection shield which is spaced from the exhaust opening for preventing the direct, linear escape of heat and exhaust gas produced at the manifold burner by the combustion of the vented fuel.

In accordance with one aspect of the above method a deflection shield is provided with a curved surface facing the manifold burner.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention.

Figure 1:
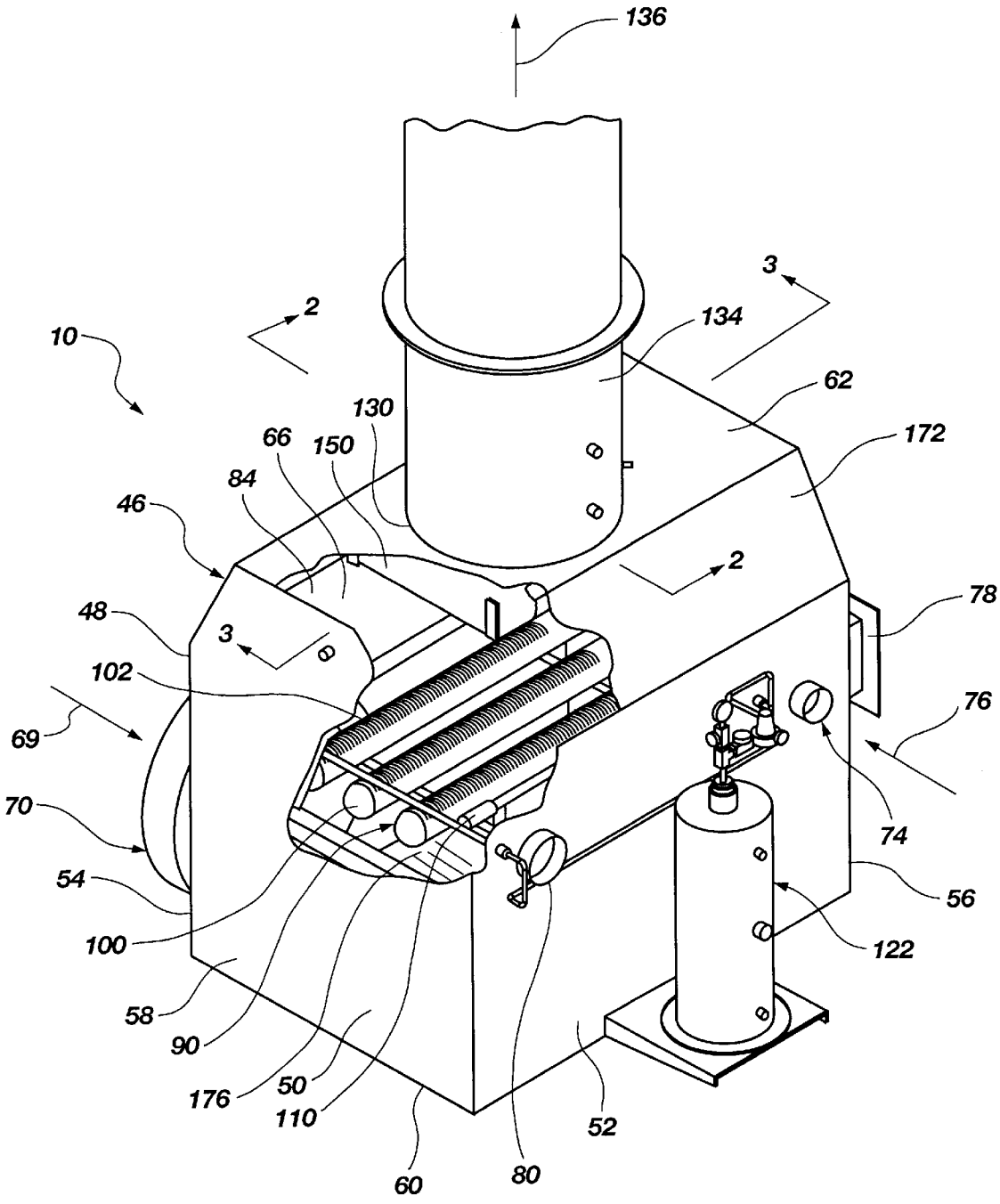
FIG. 1 is a perspective view of a preferred embodiment of a device for burning vented fuels of the present invention with a portion of a housing wall broken away to reveal a combustion chamber.
Figure 6:
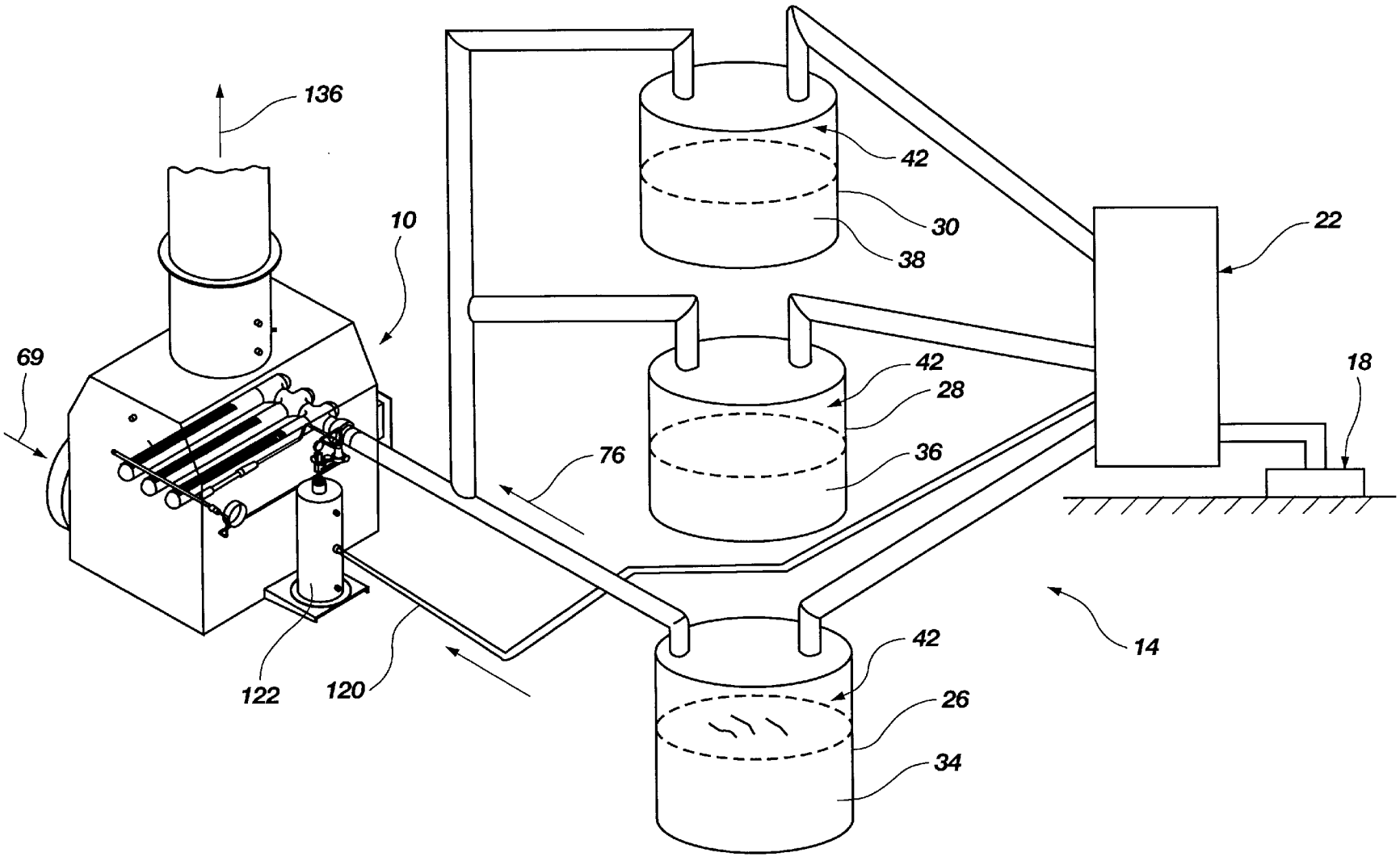
FIG. 6 is a schematic view of the preferred embodiment of the device for burning vented fuels of the present invention connected to storage tanks and a well head.

As illustrated in FIGS. 1 and 6, a burner device for burning vented fuels, indicated generally at 10, in accordance with the present invention is shown. Referring to FIG. 6, the device 10 is shown schematically in operation with a fuel/oil production site, indicated generally at 14, having a well or well head, indicated generally at 18. As indicated above, during the fuel/oil production process, a mixture of oil, water and condensate are typically extracted from the well head 18. The well head 18 is connected by a pipe or pipe system to a separator system, indicated generally at 22. The mixture of oil, water and condensate is piped from the well head 18 to the separator system 22 through the pipe system. The separator system 22 separates the oil, water and condensate, as is well known in the art. The separator system 22 is connected by pipes or a piping system to a plurality of storage tanks 26, 28 and 30. The oil, water and condensate are piped from the separator system 22 to the storage tanks 26, 28 and 30, respectively. Thus, the storage tanks include an oil tank 26 for receiving and holding oil 34, a water tank 28 for receiving and holding water 36, and a condensate tank 30 for receiving and holding condensate 38.

Vapors or vented fuels, indicated generally at 42 are created by the oil 34, water 36, and condensate 38 in each storage tank 26, 28 and 30. As indicated above, these vented fuels 42 are typically vented to the atmosphere, or inefficiently burned off by a flare. Venting the vented fuels to the atmosphere causes harmful pollution, and inefficiently burning the vented fuels can cause even more harmful pollution. In accordance with the present invention, however, the storage tanks 26, 26 and 30 are connected by pipes or a piping system to the burner device 10 of the present invention. Thus, the vented fuels 42 are piped from the storage tanks 26, 28 and 30 to the burner device 10. The burner device 10 is preferably located at least 100 feet from the well head 18, and/or other systems and structures associated with the site 14, for safety reasons.

Referring to FIG. 1, the burner device 10 has housing, indicated generally at 46, with housing walls 48. The housing walls 48 preferably form a rectangular, or square, box. The walls 48 include side walls 50, such as a front wall 52, back wall 54, right side wall 56, and a left side wall 58. The side walls 50 are attached to adjacent side walls along their respective sides to form a rectangle or square. The walls 48 also include a bottom wall 60 and a top wall 62. The bottom wall 60 is coupled to the side walls 50 along their bottom sides to enclose the bottom of the housing 46. Similarly, the top wall 62 is coupled to the side walls 50 along their top sides to enclose the top of the housing 46. Together, the walls 48 substantially enclose the housing 46 and define a combustion chamber 66. The housing walls 48 are configured for containing combustion of the vented fuels.

The back wall 54 of the housing 46 defines an air inlet 68 through the back wall 54 for allowing air into the combustion chamber 66 as indicated by arrow 69. The air inlet 68 preferably is located at or near the bottom of the back wall 54 or housing 46, as discussed more fully below. A flame arrester, indicated generally at 70, as is well known in the art, preferably is coupled to the air inlet 66 to prevent any combustion from escaping the housing 46. The front wall 52 of the housing defines a vented fuel inlet 74 through the front wall 52 for allowing vented fuel into the combustion chamber 66. A pipe (not shown) or portion (not shown in FIG. 1) of a manifold may extend through the vented fuel inlet 74 to convey the vented fuel into the housing 46 and combustion chamber 66 as indicated by 76. A manifold access opening 78 is formed in the right side wall 56 for allowing access to a manifold. A pilot access opening 80 is formed in the front wall 52 to allow access to a pilot burner. It is of course understood that the designation of front, back, and left and right side walls is for identification purposes only, and that the inlets 68 and 74 may be formed in any appropriate wall.

The housing 46 may be divided into two portions including an upper portion 84 containing the combustion chamber 66, and a lower portion 86 defining a plenum. The air inlet 68 is preferably formed in the housing walls 48 at a lower portion, or such that the air inlet 68 leads into the plenum 86. The plenum 86 provides a chamber for receiving air and is preferably maintained at a higher pressure to prevent combustion from escaping from the combustion chamber 66.

A manifold or manifold burner, indicated generally at 90, is disposed in the combustion chamber 66, or in the housing 46 for conveying the vented fuel into the combustion chamber 66. The manifold 90 preferably is disposed near or at the middle of the housing 46, and may divide the housing 46 into the upper and lower portions 84 and 86. The manifold 90 has a manifold wall 94 defining a passage 96 through the manifold 90. The manifold 90 may have a main branch 98 and a plurality of legs or secondary branches 100 extending from the main branch 98. The main branch 98 extends from the vented fuel inlet 74, preferably along one side of the housing 46 or chamber 66. The legs 100 extend out into the chamber 66 along a common, horizontal plane. Thus, the manifold 90 extends substantially across the housing 46 or combustion chamber 66. A plurality of openings 102 are formed in the manifold 90 or legs 100. Thus, the openings 102 are located across the combustion chamber 66 and convey a flow of the vented fuel into and across the chamber 66. The manifold 90 may be modular so that the number of legs 100 may be varied to fit the size of the chamber 66.

An ignition device 110, such as a pilot light or pilot burner, is disposed in the combustion chamber 66 adjacent the openings 102 in the manifold 90. The ignition device 110 ignites the vented fuel exiting the openings 102 in the manifold 90 and entering the chamber 66. The ignition device 110 preferably burns continuously or has a flame which burns continuously. Thus, an intermittent flow of vented fuel may be burned or combusted as it is produced with the ignition device 110 igniting the vented fuel as it enters the chamber 66.

Referring to FIG. 6, the ignition device 110 preferably is a pilot burner fueled by oil or gas from the separator 22, or the oil tank 26. A supply line 120 may extend from the separator 22 to a scrubber 122 for conveying oil from the separator 22. The pilot burner 110 is coupled to the scrubber 122, as is well known in the art.

It is of course understood that the ignition device 110 may be any appropriate means for igniting the vented fuel, such as an electric powered sparker. Fueling the pilot burner 110 with fuel from the site 14, however, may be more convenient and does not require an electric power source or an electrical system.

Figure 3:
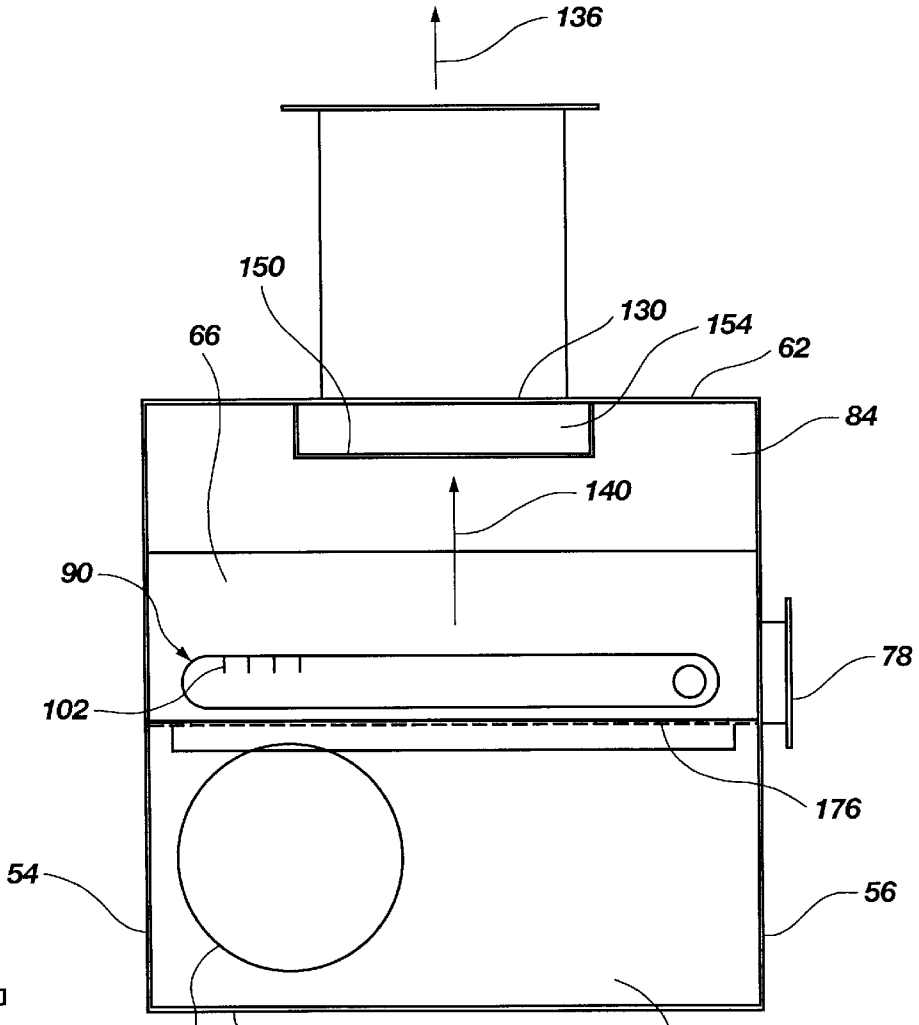
FIG. 3 is a cross-sectional front view of the preferred embodiment of the device for burning vented fuels of the present invention taken along line 3—3 of FIG. 1.
Figure 2:
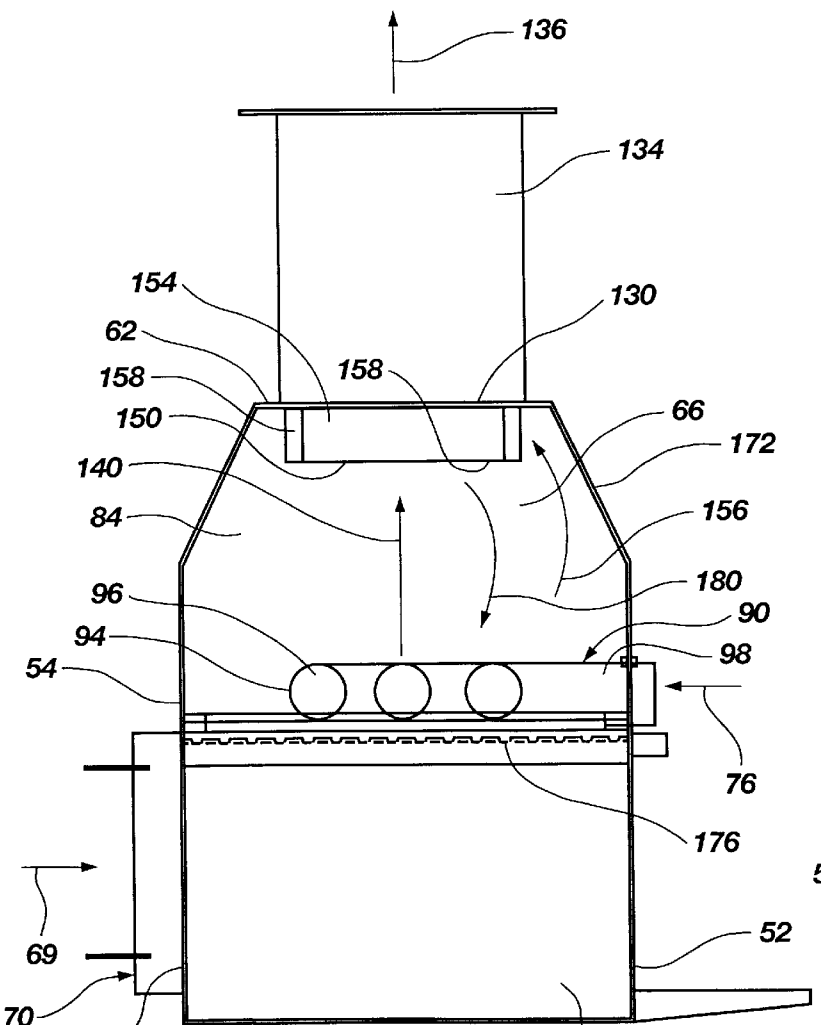
FIG. 2 is a cross-sectional side view of the preferred embodiment of the device for burning vented fuels of the present invention taken along line 2—2 of FIG. 1.

Referring again to FIGS. 1–3, the top wall 62 of the housing 46, or housing wall 50, defines an exhaust opening 130 for allowing exhaust gases produced by the combusting vented fuel to escape from the chamber 66. Thus, the exhaust opening 130 extends through the top of the housing 46, or through the top wall 62, to the exhaust chamber 66. The exhaust opening 130 preferably is positioned above the manifold 90. A stack 134 is coupled to the top wall 62 of the housing 46 and extending upwardly for conveying the exhaust gases away from the burner device 10 as indicated by arrow 136.

A direct exhaust gas path, indicated by the arrow at 140, is defined by the exhaust opening 130 and the manifold 90, and extends linearly from the manifold burner 90 to the exhaust opening 130. The direct exhaust gas path 140 generally represents the path that exhaust gas would follow from the manifold 90 to the exhaust opening 130. Because the exhaust opening 130 preferably is disposed above the manifold 90, the direct exhaust gas path is oriented generally vertically. It is of course understood that the exhaust opening 130 may be off-set from a position directly above the manifold 90, or may be formed in one of the side walls 50.

As indicated above, the air inlet 68 preferably is located at a lower end of the housing 46, and below the manifold 90 in the lower portion 86 of the housing 46. Thus, the manifold burner 90 is located between the air inlet 68 and the exhaust outlet 130. Therefore, an air flow path is defined from the air inlet 68, past the manifold 90, and upwardly towards the exhaust outlet 130.

The burner device 10 advantageously has a deflection shield 150 disposed in the direct exhaust gas path 140 for substantially deflecting exhaust gas and heat produced by the combustion of vented fuel away from the exhaust gas outlet 130, and preventing the direct escape of exhaust gas and heat from the combustion chamber 66. The deflection shield 150 may be a plate sized at least as large as the approximate size of the exhaust gas outlet 130, or to extend across the exhaust gas opening 130, to prevent the direct escape of exhaust gas and heat. In addition, the plate 150 may be sized larger than the exhaust opening 130 to prevent exhaust gas and heat from merely flowing around the plate 150. The deflection shield 150 preferably is parallel to a plane common to the manifold burner 90, and perpendicular to the direct exhaust gas path 140.

The deflection shield 150 is spaced from the exhaust gas outlet 130, and the top wall 62, creating a gap 154 between the deflection shield 150 and the top wall 62 around the exhaust gas opening 130. The gap 154 allows exhaust gas to escape from the combustion chamber 66 along a nonlinear, non-direct path, indicated by arrow 156. The deflection shield 150 is suspended from the top wall 62, or fixed at a distance from the exhaust gas opening 130, by a plurality of support members 158 extending between the top wall 62 and the deflection shield 150.

Figure 5:
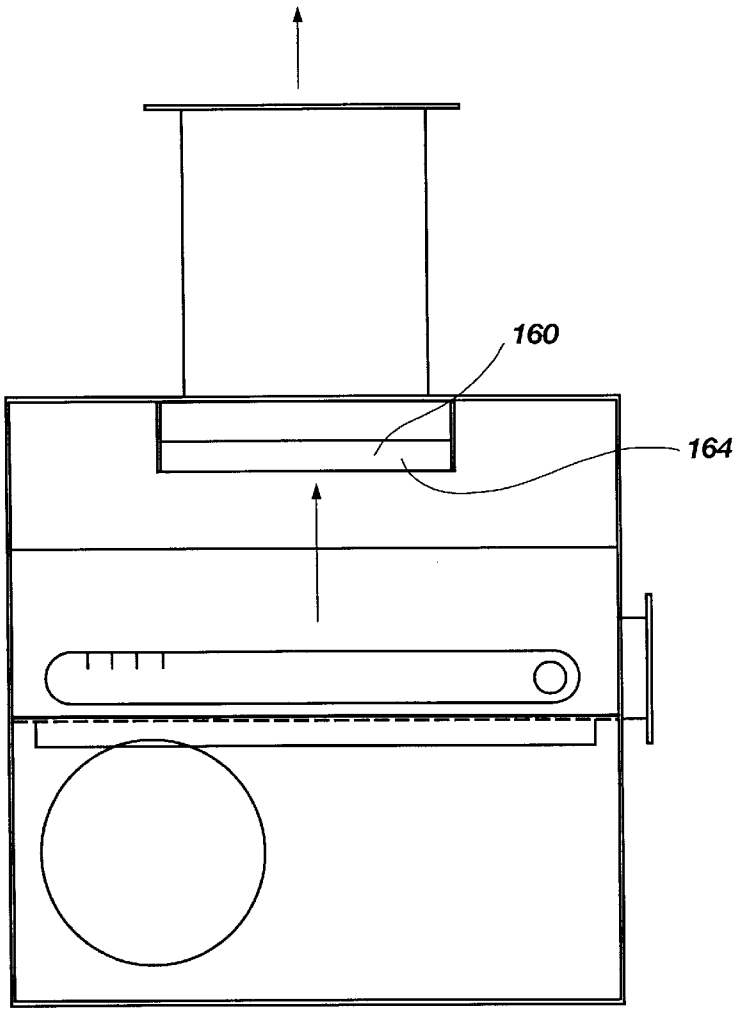
FIG. 5 is a cross-sectional front view of the alternative embodiment of the device for burning vented fuels of the present invention.
Figure 4:
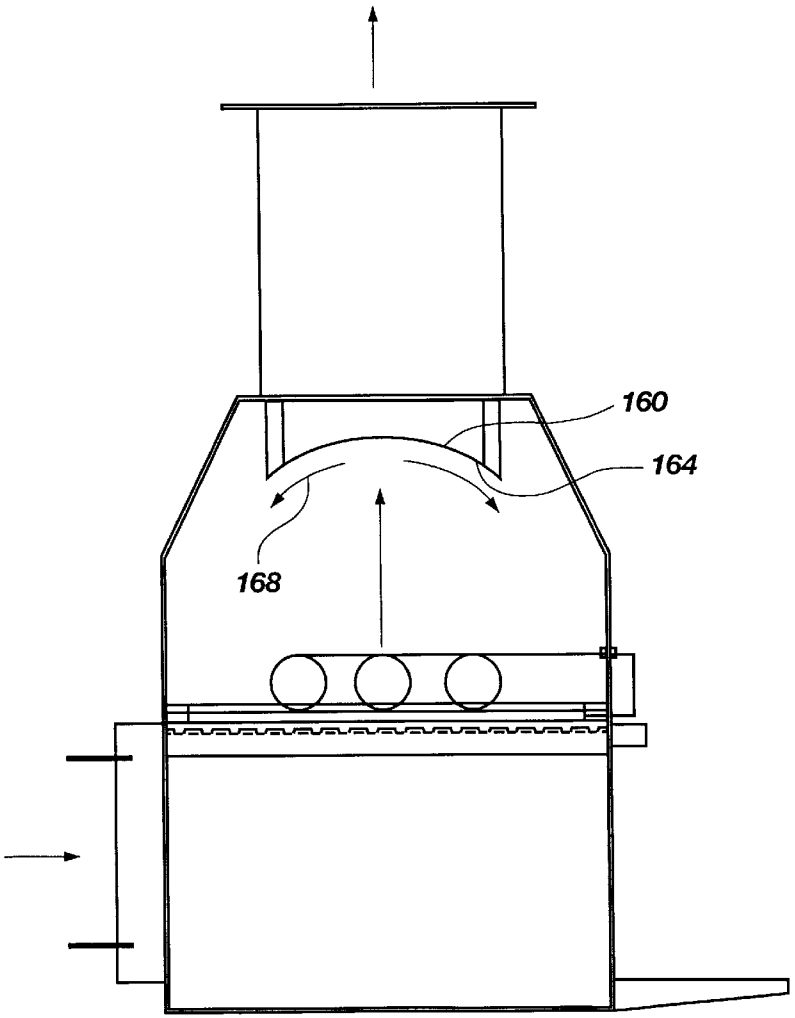
FIG. 4 is a cross-sectional side view of an alternative embodiment of a device for burning vented fuels of the present invention.

The deflection shield 150 may be rectangular, as shown, and match the shape of the housing 46 or combustion chamber 66. Alternatively, the deflection shield 150 may be any appropriate shape, such as circular, and match the shape of the exhaust gas outlet 130. The deflection shield 150 has a surface 158 facing the combustion chamber 66. The surface 158 may be substantially planar or flat, as shown. Referring to FIGS. 4 and 5, an alternative deflection shield, indicated generally at 160, is curved, or has a surface 164 with a concave curvature. The concave curvature of the surface 164 may be formed by curving or bending the plate 160. The concave curvature of the surface 164 may create a downward flow of exhaust gas, indicated by arrows 168, and recycle the exhaust gases back around the manifold 90. The concave curvature of the surface 164 has a central axis perpendicular to the manifold 90.

Referring again to FIGS. 1–3, the upper portion of the housing 46, or housing walls 48, includes angled walls 172. The angled walls 172 may be formed by an upper portion of the side walls 50, or front and back walls 52 and 54, or by side portions of the upper wall 62. The angled walls 172 taper towards the exhaust opening 130 and funnel the exhaust gases towards the exhaust opening 130.

A grating 176 is disposed between the upper and lower portions 84 and 86 of the housing 46 beneath the manifold 90. The grating 176 divides the housing 46 into the upper and lower portions 84 and 86, or the combustion chamber 66 and the plenum. The grating 176 has a plurality of openings through which air passes from the air inlet 68 and plenum to the manifold 90. It is believed that the grating 176 may contribute to turbulent air flow which may increase the efficiency of the combustion.

Referring again to FIG. 6, and as described above, oil 34, water 36, and condensate 38 produced from the well head 18 is separated by the separator system 22 and directed to separate storage tanks 26, 28 and 30. Vapors, or vented fuel 42, are created intermittently or continuously in the storage tanks 26, 28 and 30, and conveyed to the burner device 10 of the present invention. Referring again to FIGS. 1–3, in operation the ignition device 110, such as a pilot burner, burns continuously, or has a continuous flame, so that the vented fuel may be introduced into the chamber 66 intermittently. The vented fuel is introduced into the combustion chamber 66 by the manifold 90. The vented fuel flows into the housing 46 through the vented fuel inlet 74, and flows through the manifold 90 and into the combustion chamber 66 through the openings 102. Air is introduced into the plenum 86 of the housing 46 through the air inlet 68. Air passes from the air inlet 68 and plenum 86, past the grating 176 and manifold 90. It is believed that the grating 176 causes a turbulent air flow and thus assists in a more efficient combustion. The vented fuel is ignited by the ignition device 110 as it enters the combustion chamber 66 from the manifold 90.

The vented fuel and air combust in the combustion chamber 66 producing exhaust gas and heat. This exhaust gas and heat tends to flow upward along the direct exhaust gas path 140, and thus towards the exhaust gas outlet 130. The deflection shield 150, which is placed in the direct exhaust gas path 140 and spaced from the exhaust opening 130, obstructs the direct, linear escape of heat and exhaust gas from the combustion chamber 66 and housing 46. The deflection shield 150 tends to deflect or redirect the exhaust gas and heat back into the combustion chamber 66 and towards the manifold 90. It is believed that preventing the direct escape of the heat generated by the combustion helps to heat the combustion chamber 66 to a more elevate temperature such that the volatile oil compounds in the vented fuel are combusted, and thus increasing the efficiency of the burner device 10. In addition, it is believed that the exhaust gas is recycled back through the combustion chamber 66 along a recycle or re-circulation path, indicated by arrow 180, where any vented fuel which was not combusted on the first pass is combusted. The exhaust gas may be re-circulated, or travel along the direct exhaust gas path 140 and back on the recycle path 180, one or more times before escaping from the chamber 66 along the indirect path 156. The exhaust gas exits the housing 46 through the exhaust gas outlet 130 and travels up the stack 134. In addition, the deflection shield 160 may have a curved surface 164 for helping re-circulate the exhaust gases, as shown in FIGS. 4 and 5.

The deflection shield 150 and burner device 10 of the present invention presents a significant advantage over prior art flares. In prior art devices, where the vented gas is merely flared or burned off, the vented fuel typically is not completely combusted, or is perhaps 60 to 65% combusted. The efficiency of the burner device 10 of the present invention is up to 99.9% efficient, or combusts up to 99.9% of the vented fuel.

It is to be understood that the described embodiments of the invention are illustrative only, and that modifications thereof may occur to those skilled in the art. For example, the helical track may be formed on the exterior surface of a shaft or the internal surface of a cavity, while the shaft or cavity may be fixedly coupled to the head or the piston. Accordingly, this invention is not to be regarded as limited to the embodiments disclosed, but is to be limited only as defined by the appended claims herein.

What is claimed is:

1. A device configured to burn vented fuel from a storage tank of a fuel/oil production site, comprising:

a housing defining and substantially enclosing a combustion chamber, the housing having an air inlet configured for allowing air into the combustion chamber, a vented fuel inlet configured for allowing vented fuel into the combustion chamber, and an exhaust gas outlet configured for allowing exhaust gas out of the combustion chamber;

a manifold burner, disposed in the housing, configured to convey the vented fuel into the combustion chamber, the manifold burner and exhaust gas outlet defining a direct exhaust gas path extending linearly from the manifold burner to the exhaust gas outlet; and a deflection shield, disposed in the direct exhaust gas path, having a size at least as large as the approximate size of the exhaust gas outlet, configured to substantially deflect exhaust gas and heat produced by the combustion of vented fuel away from the exhaust gas outlet, the deflection shield being displaced from the exhaust gas outlet to create a gap configured to allow exhaust gas to escape the combustion chamber along a nonlinear path, such that exhaust gas and heat produced by the combustion of vented gas are prevented from flowing directly out of the combustion chamber along the direct exhaust path.

2. The device of claim 1, wherein the deflection shield comprises a plate spaced from the exhaust gas outlet defining the gap between the plate and the housing around the exhaust gas outlet, the plate being sized to extend substantially across the exhaust gas outlet.

3. The device of claim 2, wherein the plate has a surface facing the combustion chamber, the surface having a concave curvature configured for creating a downward flow of exhaust gas.

4. The device of claim 1, further comprising a grating disposed in the housing below the manifold burner and dividing the housing into two portions including the combustion chamber and a plenum, the plenum being configured for receiving air from the air inlet.

5. The device of claim 1, wherein the housing has a lower end and wherein the air inlet is located at the lower end of the housing, wherein the manifold burner is located between the air inlet and the exhaust outlet such that an air flow path is defined from the air inlet, past the manifold burner, and upwardly towards the exhaust gas outlet, and wherein the plate is disposed between the exhaust gas outlet and manifold burner such that the plate redirects the exhaust gas back towards the manifold burner such that a recirculating exhaust flow path is defined from the plate, back towards the manifold burner, and upwardly towards the gap and out the exhaust gas outlet.

6. A device configured to burn vented fuel from a storage tank of a fuel/oil production site, comprising:

a housing having a housing wall defining a combustion chamber configured for containing combustion of the vented fuel, the housing wall including side walls surrounding the housing and top and bottom walls;

an air inlet formed in the housing wall configured for allowing air into the combustion chamber;

a vented fuel inlet formed in the housing wall configured for allowing the vented fuel into the chamber;

a vented fuel pipe, configured to extend between the vented fuel inlet of the housing and at least one storage tank of the fuel/oil production site;

a manifold burner, disposed in the chamber and coupled to the vented fuel pipe, having a manifold wall defining a passage and openings configured to convey a flow of the vented fuel from the at least one storage tank of the fuel/oil production site into the combustion chamber;

an exhaust opening formed in the top wall of the housing wall configured for allowing exhaust gas produced by combusting vented fuel to escape from the chamber, the exhaust opening and manifold defining a direct exhaust gas path extending linearly from the manifold burner to the exhaust opening; and a plate, disposed in the direct exhaust gas path and spaced from the exhaust opening defining a gap between the plate and the top wall around the exhaust opening, the plate being sized to extend substantially across the exhaust opening, such that the plate blocks exhaust gas and heat produced by the combustion of the vented fuel from flowing directly out of the combustion chamber along the direct exhaust path, such that a substantial amount of heat produced by the combustion of the vented fuel is prevented from directly escaping from the housing through the exhaust opening, such that the combustion chamber is heated to a temperature to substantially consume volatile oil compounds in the vented fuel.

7. The device of claim 10, wherein the plate has a surface facing the combustion chamber, the surface having a concave curvature configured for creating a downward flow of exhaust gas.

8. The device of claim 6, wherein the exhaust opening is disposed above the manifold burner such that the direct exhaust gas path is oriented vertically, and wherein the plate is disposed below the exhaust opening and above the manifold burner.

9. The device of claim 6, further comprising a grating disposed in the housing below the manifold burner and dividing the housing into two portions including the combustion chamber and a plenum, the plenum being configured for receiving air from the air inlet.

10. The device of claim 6, wherein the plate is sized larger than the exhaust opening.

11. The device of claim 6, wherein the housing walls include angled walls tapering towards the exhaust opening configured for funneling exhaust gas towards the exhaust opening.

12. The device of claim 6, wherein the housing has a lower end and wherein the air inlet is located at the lower end of the housing, wherein the manifold burner is located between the air inlet and the exhaust outlet such that an air flow path is defined from the air inlet, past the manifold burner, and upwardly towards the exhaust outlet, and wherein the plate is disposed between the exhaust outlet and manifold burner such that the plate redirects the exhaust gas back towards the manifold burner such that a recirculating exhaust flow path is defined from the plate, back towards the manifold burner, and upwardly towards the gap and out the exhaust outlet.

13. A method for burning vented fuel from storage tanks of a fuel/oil production site, comprising:

a) providing a substantially enclosed combustion chamber having an air inlet, a vented fuel inlet, and an exhaust gas outlet;

b) providing a manifold burner in the combustion chamber and having a passage and outlets for introducing the vented fuel into the combustion chamber, the manifold burner and exhaust outlet defining a direct exhaust gas path extending linearly from the manifold burner to the exhaust gas outlet;

c) introducing air into the chamber through the air inlet;

d) communicating the vented fuel from at least one storage tank of the fuel/oil production site through a vented fuel pipe extending between the manifold burner and the at least one storage tank, and introducing the vented fuel into the chamber through the outlets in the manifold burner;

e) igniting the vented fuel and combusting the vented fuel; and f) obstructing the direct exhaust gas path with a deflection shield which is spaced from the exhaust gas oulet for preventing the direct, linear escape of heat and exhaust gas produced at the manifold burner by the combustion of the vented fuel.

14. The method of claim 13, further comprising:

g) recirculating the exhaust gas back towards the manifold burner with the deflection shield.

15. The method of claim 13, wherein step f) further comprises providing a deflection shield with a curved surface facing the manifold burner.

16. The device of claim 1, further comprising:

at least one storage tank, configured to store oil, water, or condensate; and a vented fuel pipe, coupled to and between the at least one storage tank and the manifold burner, configured to convey vented fuel from the at least one storage tank to the manifold burner.

17. The device of claim 1, wherein the manifold burner includes a main branch and a plurality of legs extending from the main branch, wherein the manifold burner extends substantially across the combustion chamber.

18. The device of claim 4, wherein the grating is a mesh grating having a plurality of openings therethrough.

19. The device of claim 6, further comprising:

a plurality of storage tanks, including:
an oil tank configured to store oil,
a water tank configured to store water, and
a condensate tank configured to store condensate;

and wherein the vented fuel pipe is coupled to and between the plurality of storage tanks, and the manifold burner.

20. The device of claim 19, further comprising:

a well head, coupled to the plurality of storage tanks.

21. The method of claim 13, further comprising:

providing a vented fuel pipe between the at least one storage tank and the manifold burner.

* * * * *